US007103304B2

(12) United States Patent
Hara

(10) Patent No.: US 7,103,304 B2
(45) Date of Patent: Sep. 5, 2006

(54) ELECTRICALLY CONDUCTIVE MEMBER, UNIT FOR CLEANING IMAGE HOLDING MEMBER, PROCESS CARTRIDGE AND IMAGE FORMING APPARATUS

(75) Inventor: Yukio Hara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 106 days.

(21) Appl. No.: 10/731,003

(22) Filed: Dec. 10, 2003

(65) Prior Publication Data

US 2004/0265007 A1 Dec. 30, 2004

(30) Foreign Application Priority Data

Jun. 26, 2003 (JP) ..... 2003-183276

(51) Int. Cl.
*G03G 15/02* (2006.01)
*G03G 15/16* (2006.01)
*G03G 21/00* (2006.01)

(52) U.S. Cl. ..... 399/176; 361/225; 399/308; 399/313; 399/357

(58) Field of Classification Search ..... 399/349, 399/343, 357

See application file for complete search history.

(56) References Cited

U.S. PATENT DOCUMENTS 5,031,000 A * 7/1991 Pozniakas et al. ..... 399/349
5,479,249 A * 12/1995 Jugle et al. ..... 399/349
6,555,210 B1 * 4/2003 Masuda et al. ..... 399/174 X
2003/0039494 A1 * 2/2003 Shakuto et al. ..... 399/357
2003/0039495 A1 * 2/2003 Takami et al. ..... 399/357
2004/0062568 A1 * 4/2004 Nukada et al. ..... 399/353 X

FOREIGN PATENT DOCUMENTS

JP A 60-6977 1/1985
JP A 1-312578 12/1989
JP A 3-196083 8/1991
JP 03-242678 A * 10/1991
JP 04-124690 A * 4/1992

* cited by examiner

*Primary Examiner*—Sophia S. Chen
(74) *Attorney, Agent, or Firm*—Oliff & Berridge, PLC

(57) ABSTRACT

The present invention provides an electrically conductive member including a core and a resin layer provided on an outer peripheral surface of the core, wherein the resin layer is made of a resin composition in which an electrically conductive agent is dispersed, and the abrasion amount of the resin composition, measured by JIS K6902, is 20 mg or less. Moreover, the present invention provides a unit for cleaning an image holding member, a process cartridge, and an image forming apparatus each using the electrically conductive member.

17 Claims, 6 Drawing Sheets

ELECTRICALLY CONDUCTIVE MEMBER, UNIT FOR CLEANING IMAGE HOLDING MEMBER, PROCESS CARTRIDGE AND IMAGE FORMING APPARATUS

CROSS-REFERENCE TO RELATED APPLICATION

This application claims priority under 35 USC 119 from Japanese Patent Application No. 2003-183276, the disclosure of which is incorporated by reference herein.

BACKGROUND OF THE INVENTION

1. Field of the Invention

The present invention relates to an electrically conductive member such as a charging member, a transfer member and a supporting member; a unit for cleaning an image holding member; and a process cartridge and an image forming apparatus using the same.

2. Description of the Related Art

In recent years, many image forming apparatuses for forming images by an electrophotographic method often include functional rollers such as a charging member, a transfer member, and a supporting member. The functional roller used herein has a desired electrical resistivity, as well as hardness, rigidity, strength, deflection, and/or surface smoothness suitable for the application thereof.

Many of the above-mentioned currently used functional rollers have semiconductive properties, comprising a core made of stainless or iron and a layer of synthetic rubber or thermoplastic resin containing carbon, a metal filler or an ion conductive agent, and whose electrical resistivity is adjusted to about $1\times10^5$ to about $1\times10^{10}$ ohm.

However, the functional roller mainly made of the synthetic rubber has the following drawbacks.

(1) The rubber of an elastic layer of the functional roller includes various components such as: residuals of a reaction initiator added to a reaction system during synthesis of a base polymer, and a by product accompanying the synthesis; a low molecular component of the base polymer; and a vulcanizer, a softener and a plasticizer added to the system during molding of a rubber roller. Many of these components easily react with the surface of a photoreceptor that is an image holding member. If the semiconductive roller is left for a long time in pressurized contact with the photoreceptor (image holding member), these components seep from the functional roller and adhere to the photoreceptor or react with the photoreceptor to reform the photoreceptor.

A solution to this problem is to form, on the functional roller surface, a barrier layer for preventing the components contained in the functional roller from seeping out. However, such a roller has a multilayered structure, resulting in increased material costs and complication of a manufacturing process, and therefore increased costs of the functional roller.

(2) In a conventional functional roller, the electrical resistivity thereof is adjusted by mechanically dispersing carbon, a metal filler, or an ion conductive agent and the like in a rubber material. Accordingly, in functional rollers having a rubber layer in which carbon is dispersed, control of the electrical resistivity thereof tends to be difficult or the electrical resistivities of the functional rollers often become uneven. Moreover, in functional rollers including the ion conductive agent, the ion conductive agent seeps out in an environment of high temperature and high humidity, and contaminates an image holding member (photoreceptor and/or intermediate transfer member).

(3) In recent years, quiet operations are also required of image forming apparatuses. A so-called "charging sound" which a charging roller generates when a high frequency AC bias is superimposed on a DC bias is an unpleasant, offensive sound, and reduction thereof has become a major technical issue.

As one method for reducing the charging sound, a method has been proposed in which a weight is put into the interior of a photoreceptor serving as an image holding member, thus preventing high frequency vibrations caused by the charging roller from propagating. However, this method requires the weight to remain fixed and a new (adhesion) process for fixing the weight inside of the photoreceptor serving as the image holding member, inevitably leading to increased costs. Moreover, as an alternative for preventing charging sound, a method has been adopted in which a foamed layer is provided on a charging roller to enable the charging member itself to absorb the vibrations. However, in this method, since the foamed layer is made of a rubber material, the aforementioned problems (1) and (2) cannot be avoided.

(4) As a measure for reducing the charging sound and preventing scraping of a photoreceptor acting as an image holding member, so-called "DC charging" has been proposed in which only a DC bias is applied to a charging roller. However, in order to realize even DC charging, the charging roller is required to have a more uniform resistivity and a smoother surface than ever. It is extremely difficult for a conventional functional roller in which a conductive agent is kneaded with and dispersed in a rubber material to form clear images with DC charging (i.e., to uniformly charge the image holding member).

(5) Moreover, for reduction in unit price of prints and photocopies (referred to as reduction in running costs), a longer life of a photoreceptor as an image holding member and various types of functional rollers have been desired.

In particular, when a high frequency AC bias is superimposed on a DC bias, discharge produced in a tiny gap between a photoreceptor serving as an image holding member and a charging roller scrapes the surface of the photoreceptor acting as the image holding member due to a so-called "etching action," greatly influencing the life of the photoreceptor serving as the image holding member. Moreover, these various types of functional rollers have a drawback in that electrifying the functional rollers for a long period of time gradually increases the electrical resistivity of the rollers, which remains a major issue to be solved.

Meanwhile, as a cleaning unit in an image forming apparatus such as an electrophotographic copier, a cleaning blade made of an elastic material such as rubber is conventionally used. A well known structure of such a cleaning blade has one edge thereof brought into contact with the surface of an image holding member such as a photoreceptor to remove a developer, such as a toner, adhering to the surface of the image holding member.

The cleaning unit has advantages in that it has a simple structure, is inexpensive, and can efficiently remove the toner. In the cleaning unit, it is very important to bring the edge of the cleaning blade into stable contact with the image holding member surface at a uniform pressure for a long period of time.

However, fusion of the toner to the edge, adhesion of paper powder, chipping of the edge due to degradation of the blade material and the like tend to cause defective cleaning. Furthermore, in a system using a toner having a small diameter to improve image quality, adhesion of the toner to the image holding member after transfer becomes extremely high due to increase in van der Waals force. Therefore, when a cleaning blade is used in such a system, it is necessary to set the contact pressure of the blade at a high value, which often causes a frictional force between the blade and the image holding member surface to increase and the blade to warp.

As an effective cleaning method for the above-mentioned system using a toner having a small diameter, a method is known in which an auxiliary brush that rotates in contact with the image holding member is provided more upstream than a cleaning blade. In this method, the adhesion of the toner firmly adhering to the image holding member surface with van der Waals force and the like is reduced with a mechanical shear force due to rotational contact of the brush to enable the cleaning blade to easily clean the image holding member (refer to, for example, Japanese Patent Application Laid-Open (JP-A) No. 1-312578).

Unlike a method using only a cleaning blade for cleaning, this method can remove the toner having a small diameter even when the contact pressure of the blade is not set to a high value.

Incidentally, a substance having a smaller diameter (mean diameter of about 1 to 50 nm) than a toner, which is referred to as an external additive, is generally added to the surface of each of toner particles in order to ensure a powder flowing property, and charging, transferring and cleaning properties. The mixing amount of the external additive depends on the specific surface area of the toner particles. Therefore, the smaller the toner particle diameter, the greater the external additive amount. Moreover, the greater the amount of toner consumed during image formation, the greater the amount of external additive reaching a cleaning zone. For example, in a full color image forming apparatus for successively developing images with four colored toners, originals are often photographic originals, and the amount of toner consumed is about ten times as many as that in the case of ordinary monochrome originals. Accordingly, the amount of the external additive consumed is also very large.

When the cleaning method using the blade or the cleaning method using the combination of the auxiliary brush and the cleaning blade is used in full color image formation, external additive particles having a very small diameter aggregate at the edge portion of the blade. The aggregating external additive particles adhere to an image holding member surface with vibration of the blade edge when the image holding member moves (a so-called "stick-slip phenomenon"), generating substantial image defects such as filming.

In order to solve such a technical problem, a conventional cleaning method using a belt-type cleaning member, namely a so-called "web," has been well known. For example, a method has been proposed in which the belt is disposed near an image holding member surface, in which a bias having a polarity opposite to that of a toner is applied to the belt, and in which an ultrasonic vibration is applied to the image holding member.

In the method, the toner can be significantly and efficiently removed, and the toner or an external additive is not pressed against the image holding member and therefore does not adhere to the image holding member.

However, in this method, since adhesion is strong, as mentioned above, and it is difficult to completely remove a large amount of the external additive, repetition of image formation causes accumulation of the external additive on the image holding member, resulting in degradation of image quality (refer to, for example, JP-A No. 60-6977).

Moreover, a method using a belt which includes, as a part of the material therefor, fabric made of a microfiber having a diameter of 15 μm or less has been proposed. According to this method, even if a toner has a small diameter, the toner can be sufficiently removed. However, when the amount of the toner which reaches a cleaning unit is large, the belt may not function adequately (refer to, for example, JP-A No. 3-196083).

For example, in the case of a full color image forming apparatus which successively develops images with four colored toners, much photograph development is involved, thus consuming about 10 times as much toner as that in the case of ordinary monochrome documents. Therefore, the toner floods at a portion of the belt contacting an image holding member surface, and some of the toner slip through the belt or adhere to the image holding member.

Accordingly, there has been a need for an electrically conductive member which does not contaminate an image holding member and the like when brought into contact with the image holding member and the like, and can stably obtain a desired electrical resistivity, and has a long life and whose physical properties hardly change. There has also been a need for a cleaning unit which can maintain good image quality for a long period of time even when a large amount of the toner having a small diameter constantly reaches the cleaning unit, and which ensures removal of toner from an image holding member and prevents an external additive from adhering to the image holding member surface. Moreover, there has been a desire for a process cartridge and an image forming apparatus which have the electrical conductive member and/or the cleaning unit, and which are highly durable and can reduce running costs.

SUMMARY OF THE INVENTION

A first aspect of the invention is to provide an electrically conductive member comprising a core and a resin layer provided on an outer peripheral surface of the core, wherein the resin layer is made of a resin composition in which an electrically conductive agent is dispersed, and the abrasion amount of the resin composition, measured by Japanese Industrial Standard (JIS) K6902, is 20 mg or less.

A second aspect of the invention is to provide a unit for cleaning an image holding member comprising a brush member brought into contact with an image holding member surface, an electrically conductive roller brought into contact with the brush member, and a blade brought into contact with the electrically conductive roller, wherein the electrically conductive member is the above-described electrically conductive roller.

A third aspect of the invention is to provide a process cartridge including an image holding member, and a charging member disposed near or brought into contact with an image holding member surface, wherein the charging member is the above-described electrically conductive member.

A fourth aspect of the invention is to provide a process cartridge including an image holding member, and a unit for cleaning an image holding member, wherein the unit is the above-described unit for cleaning an image holding member.

A fifth aspect of the invention is to provide an image forming apparatus including the above-mentioned electrically conductive member.

A sixth aspect of the invention is to provide an image forming apparatus including the above-described unit for cleaning an image holding member.

DETAILED DESCRIPTION OF THE INVENTION

Figure 1A:
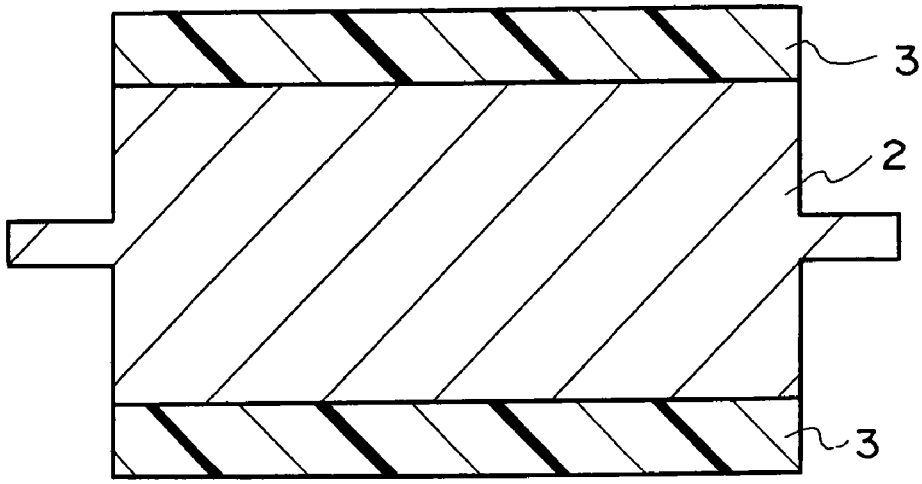
FIGS. 1A and 1B are sectional views for explaining the schematic structure of electrically conductive rollers to which an electrically conductive member of the invention is applied.

Hereinafter, the invention will be explained in detail.

Electrically Conductive Member

An electrical conductive member of the invention has a resin layer on the outer peripheral surface of a core, and the resin layer is made of a resin composition in which an electrically conductive agent is dispersed and the abrasion amount of the resin composition, measured by Japanese Industrial Standard (JIS) K6902, (hereinafter simply referred to as "the abrasion amount," in some cases) is 20 mg or less. JIS K 6902 is incorporated by reference herein. More specifically, the abrasion amount is measured with a rotary abrasion tester available from Toyo Seiki Seisaku-Sho, Ltd. as follows. A test specimen having a thickness of 4 mm is attached to a test specimen turntable with an adhesive. While the test specimen turntable is rotated at 60 rpm, a load of 4.9 N (500*g*) is pressed against an abrasion ring. Then, when the number of revolutions of the test specimen turntable reaches 100, the abrasion amount of the test specimen is measured with the tester.

Abrasion Amount

As mentioned above, the abrasion amount of the resin composition is 20 mg or less. Like an electrically conductive roller, the electrically conductive member of the invention is used in a contact state with other members such as an image holding member, a cleaning blade, a cleaning brush or a transfer member. Accordingly, when the abrasion amount of the resin composition exceeds 20 mg, such an electrically conductive member is less durable and needs to be replaced at short cycles.

The abrasion amount of the resin composition is preferably 15 mg or less and more preferably 10 mg or less.

Rockwell Hardness

In order to attain an abrasion amount of 20 mg or less, a hard resin composition, especially a resin composition having a high Rockwell hardness (M scale), stipulated in Japanese Industrial Standard (JIS) K7202, (hereinafter simply referred to as "Rockwell hardness," in some cases) can be used. JIS K 7202 is incorporated by reference herein. More specifically, the Rockwell hardness (M scale) is measured with a Rockwell hardness measuring device available from Toyo Seiki Seisaku-Sho Ltd. as follows. A test force of 98 N is pressed against a test specimen having a thickness of 4 mm with a stainless sphere having a diameter of 6.350 mm, and then the Rockwell hardness of the test specimen is measured with the measuring device.

The Rockwell hardness of the resin composition is preferably at least 100. When the resin composition has Rockwell hardness of at least 100, such a resin composition can easily have an abrasion amount of 20 mg or less, and it is possible to form hard products having high dimensional precision with the resin composition. Meanwhile, when the Rockwell hardness of the resin composition is less than 100, such a resin composition may not have an abrasion amount of 20 mg or less. The Rockwell hardness of the resin composition is preferably at least 110 and more preferably at least 120.

The Rockwell hardness of the resin composition greatly depends on the resin type. A resin including many benzene rings generally has a high Rockwell hardness. Moreover, when resins of the same kind are compared with each other, the larger the molecular weight, the higher the Rockwell hardness.

Examples of the resin contained in the resin composition include a phenol resin, a polyimide resin, polyphenylene sulfide, polyether sulfide, polyether ether imide, polyarylate, polyamideimide, polyethylene terephthalate, polybuthylene terephthalate, polycarbonate, an ABS resin, polystylene, polypropylene and polyamide. A phenole resin, a polyimide resin, polyphenylene sulfide, polyether sulfide, polyether ether imide, and polyarylate are preferable, and a polyimide resin and polyether ether imide are more preferable among these resins in that they can easily have a desired Rockwell hardness.

Moreover, in order to attain an abrasion amount of 20 mg or less, the resin composition may contain an inorganic filler which can improve abrasion resistance. Examples of the inorganic filler include molybdenum disulfide and mica each having a stratified structure, graphite and boron nitride each having a plate shape, and a fiber filler such as potassium titanate fiber, glass fiber, alumina fiber, silicon carbide fiber and aromatic polyamide fiber.

Electrically Conductive Agent

The resin composition of the invention contains an electrically conductive agent dispersed therein. Since the electrically conductive agent is dispersed in the resin composition, the electrically conductive member of the invention does not contaminate an image holding member when brought into contact with the image holding member, and can stably obtain a desired electrical resistivity.

Examples of the electrically conductive agent include carbon black; carbon powder; graphite; magnetic powder; metal oxides such as zinc oxide, tin oxide, and titanium oxide; metal sulfides such as copper sulfide and zinc sulfide; so-called "hard ferrites" such as strontium, barium, and rare earths; ferrites such as magnetite, copper, zinc, nickel and manganese; those obtained by subjecting the surface of these compounds to electrical conduction treatment; powder and fiber of a metal such as tin, iron, copper and aluminum; oxides including different metal elements such as copper, iron, manganese, nickel, zinc, cobalt, barium, aluminum, tin, lithium, magnesium, silicon, or phosphorous; so-called "composite metal oxides" which are solid solutions of metal oxides obtained by calcining hydroxides, carbonates or metal compounds at a high temperature.

An electronically conductive agent which exhibits electrical conductivity due to electronic conduction is preferably used in the invention in consideration of small change between electrical resistivity in an environment of a high temperature of 30° C. and a high humidity of 85% RH, and electrical resistivity in an environment of a low temperature of 10° C. and a low humidity of 15% RH.

Carbon black having a pH value of 5.0 or less (hereinafter referred to as "acidic carbon black" in some cases) is used as the electronically conductive agent. The pH of the acidic carbon black is preferably 5.0 or less and more preferably 4.0 or less. When the pH of the acidic carbon black is 5.0 or less, the electronically conductive agent has an improved dispersibility in the resin material, a low dependency on an electric field, and causes less electric field convergence due to effect of an oxygen-containing functional group adhering to the agent surface. Moreover, resistivity change of the agent due to environmental change can be reduced.

The acidic carbon black is subjected to oxidation treatment, if necessary, to impart a carboxyl group, a quinone group, a lactone group, a hydroxyl group or the like to the surface thereof. Examples of the oxidation treatment include an air oxidation method in which the carbon black is brought into contact with and reacted with air at an atmosphere of a high temperature, a method in which the carbon black is reacted with a nitrogen oxide or ozone at a normal temperature, and a method in which the carbon black is oxidized with air at a high temperature and thereafter oxidized with ozone at a low temperature. More specifically, an oxidized carbon black can be prepared by a contact method. Examples of the contact method include a channel method and a gas black method.

Further, the acidic carbon black can be prepared by a furnace black method using gas or oil as a raw material. After the above-described treatment, the acidic carbon black can be subjected to oxidation treatment in a liquid phase with a nitric acid or the like, if necessary. In the furnace method, carbon black having a high pH value and a low content of volatile components is usually prepared, and the oxidation treatment in a liquid phase can adjust the pH value of the carbon black. That is, the pH value of the carbon black prepared by the furnace method can be adjusted by a post-process treatment. Accordingly, carbon black which is prepared by the furnace method and whose pH value is adjusted at 5 or less by the post-process treatment is included in the electrically conductive agent used in the invention.

The pH value of the acidic carbon black can be obtained by preparing an aqueous suspension of carbon black and measuring the pH value of the suspension with glass electrodes. The pH value of the acidic carbon black can be adjusted by conditions of the oxidation treatment such as a process temperature and a process time.

The volatile component content of the acidic carbon black is preferably 1 to 25% by mass, more preferably 2 to 20% by mass, and still more preferably 3.5 to 15% by mass. When the volatile component content is less than 1% by mass, the effect of the oxygen-containing functional group adhering to the surface of the carbon black does not appear, and dispersibility of the carbon black in an elastic body (binder resin) may reduce. Meanwhile, when the volatile component content exceeds 25% by mass, carbon black may decompose at the time of dispersing the carbon black in the resin composition. Alternatively, the amount of water adsorbed by the oxygen-containing functional group on the carbon black surface may increase, which may deteriorate the appearance of the resultant formed product. Accordingly, the volatile component content of the above-mentioned range can improve dispersion of the carbon black in the binder resin.

The volatile component content can be obtained by the proportion of organic volatile components (a carboxyl group, a quinone group, a lactone group, a hydroxyl group and the like) generating in heating carbon black at 950° C. for seven minutes.

Specific examples of the acidic carbon include Regal 400R (pH: 4.0, volatile component content: 3.5%), and Monarch 1300 (pH: 2.5, volatile component content: 9.5%) available from Cabot Corporation; Color Black FW200 (pH: 2.5, volatile component content: 20%), Special Black 4 (pH: 3, volatile component content: 14%) Printex 150T (pH: 4, volatile component content: 10%) Printex 140T (pH: 5, volatile component content: 5%), and Printex U (pH: 5, volatile component content: 5%) available from Degussa Japan Co., Ltd. The acidic carbon black can be used alone or in combination with other carbon black as long as it is used as a main electronically conductive filler exhibiting conductivity.

The addition amount of the electrically conductive agent is preferably 5 to 40 parts by mass, and more preferably 10 to 30 parts by mass with respect to 100 parts by mass of the resin. When the addition amount of the electrically conductive agent is 5 to 40 parts by mass with respect to 100 parts by mass of the resin, a desired electrical resistivity can be stably obtained.

For dispersion of the electrically conductive agent, a ball mill, an attritor, a sand mill, a pressure kneader, a banbury mixer, a two-roll mixer, a three-roll mixer, and/or an extruder can be used.

The resin composition in which the electrically conductive agent is dispersed is molded into a cured body which has excellent mechanical strength such as rigidity and abrasion resistance, excellent dimensional stability, excellent controlling properties and stability of electrical resistivity including resistivity unevenness, and uniform characteristics and from which components thereof do not seep.

Accordingly, the electrically conductive member of the invention having a resin layer made of the resin composition in which the electrically conductive agent is dispersed can be used as a charging member and/or a transfer member disposed near or brought into contact with the surface of a hollow cylinder or belt-type image holding member, as a supporting roller which faces a secondary transfer member via a hollow cylinder or belt-type intermediate transfer member and to which a secondary transfer voltage is applied, as a winding roller around which a belt-type intermediate transfer member is wound in a tension condition, and/or as an electrically conductive roller in a unit for cleaning an image holding member including the electrically conductive roller brought into contact with a brush member and a blade brought into contact with the electrically conductive roller.

In the invention, when the electrically conductive member is an electrically conductive roller, the electrical resistivity of the electrically conductive roller at the time of applying a voltage of 500V thereto is preferably $1\times10^5$ to $1\times10^{10}$ ohm, and more preferably $1\times10^6$ to $1\times10^9$ ohm. The electrical resistivity of the electrically conductive roller is adjusted at the predetermined range, and the rigidity of the electrically conductive roller is improved by adding the electrically conductive agent or agents.

When the electrical resistivity of the electrically conductive roller is less than $1\times10^5$ ohm and the roller is used as a charging roller or a transfer roller, a current tends to leak in some cases. When the electrical resistivity of the electrically conductive roller exceeds $1\times10^{10}$ ohm, charge accumulation (so-called "charge up") tends to occur in some cases.

When the electrically conductive roller is used in a cleaning unit to be described later, and the electrical resistivity of the electrically conductive roller is less than $1\times10^5$ ohm, charge injection occurs. Thereafter, the polarity of fine powder such as toner particles and paper powder collected by a brush member reverses, and the electrically conductive roller cannot electrically adsorb such fine powder in some cases. When the electrically conductive roller is used in the cleaning unit and the electrical resistivity of the electrically conductive roller exceeds $1\times10^{10}$ ohm, charge accumulation (so-called "charge up") on the electrically conductive roller occurs, and the electrically conductive roller cannot electrically adsorb fine powder such as toner particles and paper powder in some cases.

The electrical resistivity of the electrically conductive roller used in the invention is a value obtained by placing the electrically conductive roller on a metal plate such as a copper plate while a load of 500 grams is applied to each end of the roller, applying a voltage of 500 V to a circuit including the electrically conductive roller (a core thereof, if any) and the metal plate, and measuring a current flowing between the electrically conductive roller and the metal plate with a microcurrent measuring device (R8320 manufactured by Advantest Corp.). The above-described procedures are conducted at 22° C. and 55% RH.

Accordingly, in the electrically conductive roller to which the electrically conductive member of the invention is applied, there is virtually no unevenness in terms of electrical resistivity, rigidity, and strength, and even characteristics can always be exhibited. Even characteristics are preferably required for a charging roller for DC charging to which only a DC bias is applied.

Moreover, the electrically conductive member of the invention can include a filler or fillers, and thereby the hardness, the rigidity and the strength thereof can be arbitrarily adjusted.

As a method of molding a resin layer in the invention, injection molding, extrusion molding, and/or press molding can be used. The extrusion molding method can mold successively, and therefore can provide an inexpensive resin layer having significantly high dimensional precision.

When the electrically conductive member of the invention is used as an electrically conductive roller and the resin layer is thin, such an electrically conductive roller may bend undesirably. Meanwhile, when the resin layer is thick, shrinkage percentage at the time of molding is high and a product having a desired dimensional precision may not be obtained. Accordingly, the thickness of the resin layer is preferably 1 to 20 mm and more preferably 2 to 10 mm.

The surface of the electrically conductive member including an electrically conductive roller obtained by any molding method can be easily polished, if necessary, to obtain a highly smooth surface.

Figure 1B:
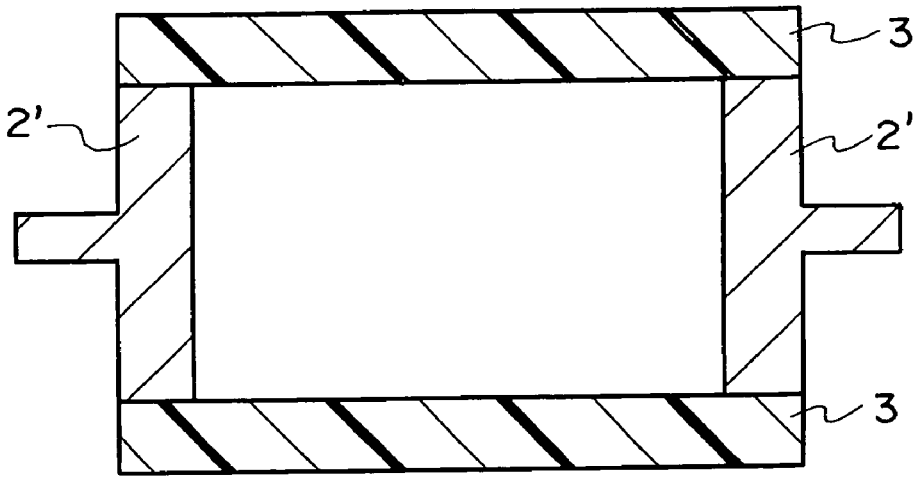

The structure of the electrically conductive roller to which the electrically conductive member of the invention is applied will be explained with reference to FIG. 1. FIG. 1 is a schematic sectional view explaining the structure of the electrically conductive roller used as the electrically conductive member of the invention. The electrically conductive roller may have a structure shown in FIG. 1A in which a metal core 2 as a core is inserted into a space between the inner surfaces of resin tubes 3, or a structure shown in FIG. 1B in which electrically conductive metal flanges 2' are press-fitted into spaces between respective ends of resin tubes 3.

The core can be made of a metal including aluminum, copper, iron, stainless, zinc or nickel, or a resin material in which an electrically conductive agent is dispersed.

The bending elastic modulus of the resin composition used in the electrically conductive member of the invention, which is stipulated in Japanese Industrial Standard (JIS) K7171, is preferably at least 2000 MPa, more preferably at least 3000 MPa and still more preferably at least 4000 MPa. JIS K7171 is incorporated by reference herein. The reason for this is as follows. When the bending elastic modulus is less than 2000 MPa, such an electrically conductive roller bends undesirably in some cases. Moreover, when an electrically conductive roller which is thick enough to obtain sufficient rigidity is made of a resin composition having a low bending elastic modulus, shrinkage percentage at the time of molding may be high and products having a desired dimensional precision may not be obtained, or costs may increase due to increased mass, lengthened molding time, and increased necessity of post-process. More specifically, the bending elastic modulus is measured with Strograph VE5D available from Toyo Seiki Seisaku-Sho Ltd. as follows. A load is pressed against the central portion of a test specimen having a thickness of 4 mm, a width of 10 mm and a length of 80 mm at a cross-head speed of 10 mm/min. Then a relationship between a bending stress and flexure is obtained. A bending elastic modulus is obtained from linear regression of a curve between two stipulated distortion points (0.0005 and 0.0025).

The electrically conductive member of the invention has been thus explained. Specific disposal and use of the electrically conductive member serving as an electrophotographic member will be described later with a process cartridge and an image forming apparatus of the invention.

Unit for Cleaning Image Holding Member

A unit for cleaning an image holding member of the invention has a brush member brought into contact with an image holding member surface, an electrically conductive roller brought into contact with the brush member, and a blade brought into contact with the electrically conductive roller, and the electrically conductive roller is the electrically conductive member of the invention.

Figure 2:
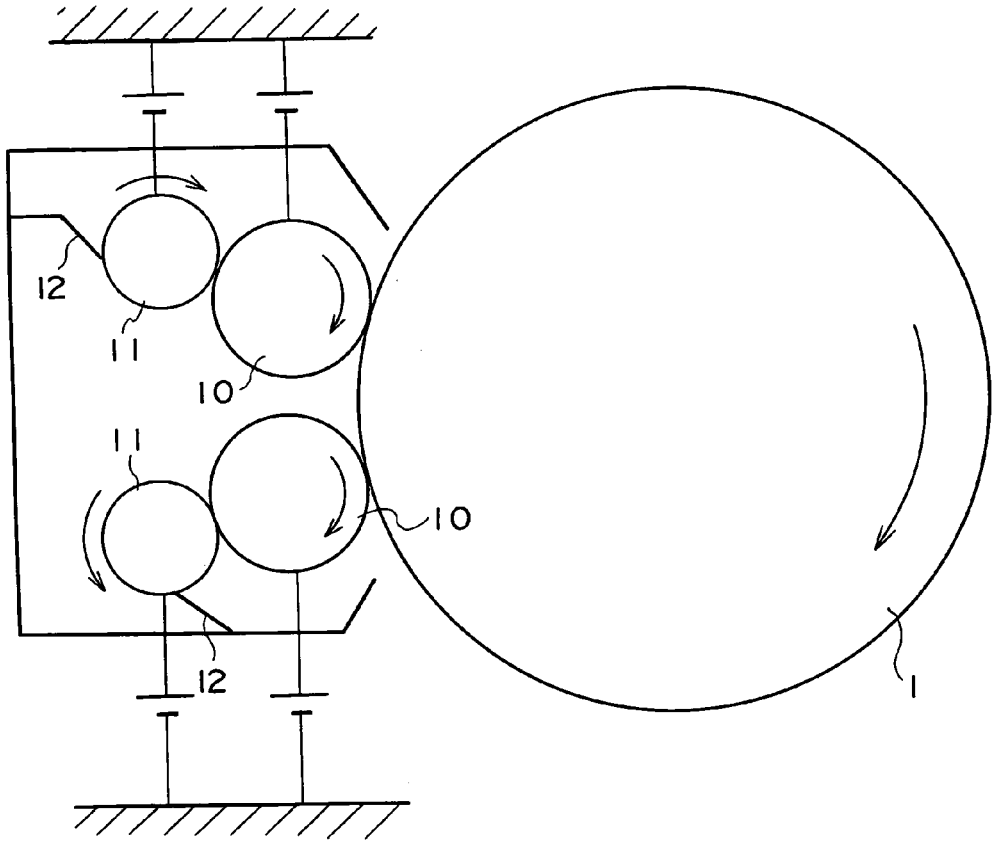
FIG. 2 shows the schematic structure of an embodiment of a unit for cleaning an image holding member of the invention.

An embodiment of the unit for cleaning an image holding member of the invention is shown as a schematic structure in FIG. 2.

As shown in FIG. 2, the unit for cleaning an image holding member of the embodiment includes brush members 10, electrically conductive rollers 11 and cleaning blades 12. Each of the brush member 10 has a rotating shaft and numberless fibers fixed at the shaft. The electrically conductive rollers 11 scrape the brush member 10.

Each of the brush members 10 has a roller shape in which numberless fibers are disposed around the outer peripheral of the rotating shaft. The brush members 10 are disposed such that the tip of each brush is slightly pressed against the image holding member. The peripheral surface of each brush member 10 rotates in a direction opposite to the moving direction of the peripheral surface of the image holding member 1, and the brush members 10 scrape the image holding member 1, remove a toner and an external additive from the surface of the image holding member 1 and carry the removed toner and external additive to the electrically conductive roller.

Specific examples of the material of the brush members 10 include fiber of a resin such as nylon, an acrylic resin, polyolefine, and polyester. The brush member can contain electrically conductive powder or an ion conductive agent to obtain electrical conductivity. Alternatively, the brush member may have an electrically conductive layer inside or outside the respective fibers.

The resistivity of the fiber itself is preferably $10^2$ to $10^9$ ohm. The thickness of the fiber is preferably 30 d (d:denier) or less and more preferably 20 d (d:denier) or less. The density of the fiber is preferably at least $3.1\times10^3$ number/cm$^2$ (20000 fibers/inch$^2$) and more preferably at least $4.7\times10^3$ number/cm$^2$ (30000 fibers/inch$^2$).

The electrically conductive rollers 11 are disposed such that the outer peripheral surface thereof is slightly pressed against the outer peripheral surface of the corresponding brush member 10. The electrically conductive rollers 11 hold the remaining toner and external additive adhering to the brush member 10. The cleaning blade 12 in contact with the corresponding electrically conductive roller 11 collects the remaining toner and external additive.

The electrically conductive roller 11 is preferably made of a thermosetting resin having good dimensional precision. Moreover, when the electrically conductive member of the invention having a resin layer in which an electrically conductive agent is dispersed and which has an abrasion amount of 20 mg or less is used as the electrically conductive roller 11, it is possible to set a contact pressure and a bite amount (press amount) of the electrically conductive roller 11 against the brush member 10 and the cleaning blade 12 at high values, and therefore the cleaning unit can stably clean the image holding member 1 for a long period of time.

Furthermore, it is preferable that the electrical resistivity of the electrically conductive roller 11 is adjusted at $10^5$ to $10^{10}$ ohm by adding an electrically conductive filler or fillers, an ion conductive agent or agents or a combination thereof.

A cleaning bias is preferably applied to the brush member 10 and the electrically conductive roller 11. It is more preferable that the potential of the cleaning bias applied to the brush member 10 is different from that applied to the electrically conductive roller 11. It is still more preferable that the cleaning bias applied to the electrically conductive roller 11 has a larger absolute value of the potential than that applied to the brush member 10, and has the same polarity as that of the cleaning bias applied to the brush member 10. In this case, the remaining toner and external additive which have been rubbed from the image holding member surface due to a mechanical shear force and the potential difference electrostatically move to the electrically conductive roller 11.

That is, the remaining toner and the like on the image holding member surface are drawn to the brush members 10 by an electrostatic attracting force due to an electric field generated between the brush members 10 to which a cleaning bias is applied and the image holding member 1, and are removed from the image holding member 1. Meanwhile, since the cleaning bias having a larger absolute value of the potential than that applied to the brush member 10 and the same polarity as that of the cleaning bias applied to each brush member 10 is applied to the electrically conductive rollers 11, the remaining toner and external additive adhering to the brush members 10 re-adhere to the electrically conductive rollers 11.

The cleaning blade 12 (or scraper 12) is brought into contact with the electrically conductive roller 11, and the cleaning blade 12 as a cleaning means removes the toner and the like adhering to the electrically conductive roller 11. The cleaning means is made of a thin metal plate of stainless or phosphor bronze from the viewpoints of high durability and low costs. The thickness of the cleaning means is preferably 0.02 to 2 mm.

Thus, the unit for cleaning an image holding member 1 of the embodiment electrostatically adsorbs fine powder such as toner particles and paper powder in an efficient manner by utilizing a potential difference between the cleaning bias applied to the brush member 10 and that applied to the electrically conductive roller 11. The absolute value of the potential difference between the cleaning bias applied to the brush member 10 and that applied to the electrically conductive roller 11 is preferably at least 100 V and more preferably at least 200 V. However, the upper limit of the potential difference is about 600 V in order to prevent charge from being injected into matters to be removed due to discharge between members, and to prevent the polarity of the matters from reversing.

It is preferable that a plurality of units for cleaning an image holding member each having the brush member 10 brought into contact with the image holding member 1, the electrically conductive roller 11 brought into contact with the brush member 10, and the cleaning blade 12 brought into contact with the electrically conductive roller 11 are provided along the moving direction of the image holding member 1, and that the polarities of voltages applied to the units for cleaning an image holding member alternate between positive and negative in the moving direction of the image holding member 1.

In this case, the toner particles remaining on the image holding member 1 after a transfer process have uneven polarities due to influence of an electric field of a transfer zone, and there even exist toner particles having negative polarity which originally had positive polarity. Therefore, it is preferable that a plurality of units for cleaning an image holding member each having the brush member 10, the electrically conductive roller 11 and the cleaning blade 12 are provided with respect to one image holding member 1, and that potential differences having different polarities are provided therebetween. Thereby, not only a toner remaining after transfer and having positive polarity but also a toner remaining after transfer and having negative polarity can be efficiently removed.

Furthermore, in the units for cleaning an image holding member provided along the moving direction of the image holding member 1, the voltage applied to the unit for cleaning an image holding member which is disposed farthest upstream among all the units for cleaning an image holding member preferably has a polarity different from that of a toner on the image holding member surface.

As described above, toner particles remaining on the image holding member surface after a transfer process is completed have uneven polarities due to influence of an electric field of a transfer zone. For example, when the transfer voltage is positive, most of the toner particles are still positive. Therefore, cleaning biases having the same polarity (positive polarity) as that of the toner remaining after transfer are applied to the unit for cleaning an image holding member (first unit for cleaning an image holding member) which is disposed farthest upstream in the moving direction of the image holding member 1, such that a potential difference exists between the cleaning bias applied to the brush member 10 and the cleaning bias applied to the electrically conductive roller 11. Thereby, the first unit for cleaning an image holding member unit electrostatically adsorbs positive toner particles which are most of the toner particles remaining after transfer. Moreover, cleaning biases having polarity (negative polarity) different from that of the toner remaining after transfer are applied to the next unit for cleaning an image holding member, such that a potential difference exists between the cleaning bias applied to the brush member 10 and the cleaning bias applied to the electrically conductive roller 11. Thereby, the unit for cleaning an image holding member electrostatically adsorbs toner particles whose polarities have reversed.

That is, in a process for developing images with a toner which can be negatively charged, the same polarity of the voltage applied to the first unit for cleaning an image holding member as that of a toner remaining after transfer means polarity (positive polarity) different from that of a toner on a developer holding member surface. In the present embodiment, it is preferable that the voltage applied to the first unit for cleaning an image holding member has polarity different from that of the toner on the developer holding member surface, and that polarities of voltages applied to subsequent units for cleaning an image holding member alternate between positive and negative.

Process Cartridge and Image Forming Apparatus

Figure 3:
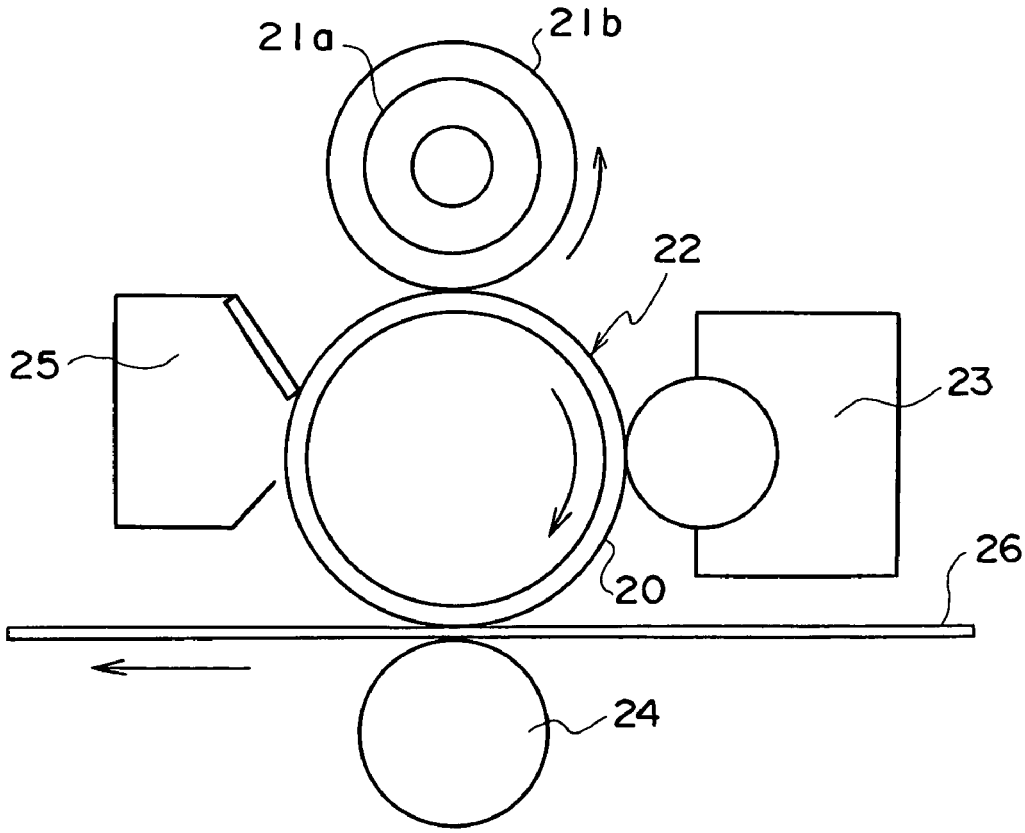
FIG. 3 shows the schematic structure of an embodiment of an image forming apparatus of the invention.

An embodiment of an image forming apparatus of the invention having the electrically conductive rollers of the invention as a charging roller (charging member) and a transfer roller (transfer member) will be explained with reference to FIG. 3. FIG. 3 is a schematic structural figure explaining the embodiment of the image forming apparatus of the invention. In the embodiment of the image forming apparatus of the invention shown in FIG. 3, a charging roller 21*a* including spacer members 21*b* uniformly charges the surface of a photoreceptor (image holding member) 20. A latent image formed on the photoreceptor 20 through image exposure 22 by a laser beam scanner is developed with a developer contained in a developing unit 23 to form a toner image. Thereafter, a transfer roller 24 transfers the toner image to the surface of a recording material 26. A cleaner 25 cleans the photoreceptor 20 surface after the transfer.

More specifically, the photoreceptor 20 is organic and can be negatively charged, and is uniformly charged by a charging means so that the photoreceptor surface has a negative potential. A negative latent image is formed on the photoreceptor surface through exposure by the laser beam scanner, and is developed through reverse development by the developing unit 23. That is, the negative latent image is visualized with a negatively charged toner having the same polarity as that of the photoreceptor 20. The resultant toner image thus formed is directly transferred to a recording material 26 by a transfer means, and then passes through a fixing unit while being heated and is pressurized by the fixing unit. Thereby, the toner image is fixed on the recording material 26 and becomes a permanent image to be discharged to a discharging tray.

Since the image forming apparatus has the charging roller and the transfer roller which are electrically conductive rollers of the invention, and charging is uniformly conducted, it enables high quality images to be obtained. Moreover, since these electrically conductive rollers has excellent abrasion resistance and resistivity stability, the image forming apparatus can form high quality images for a long period of time.

Figure 4:
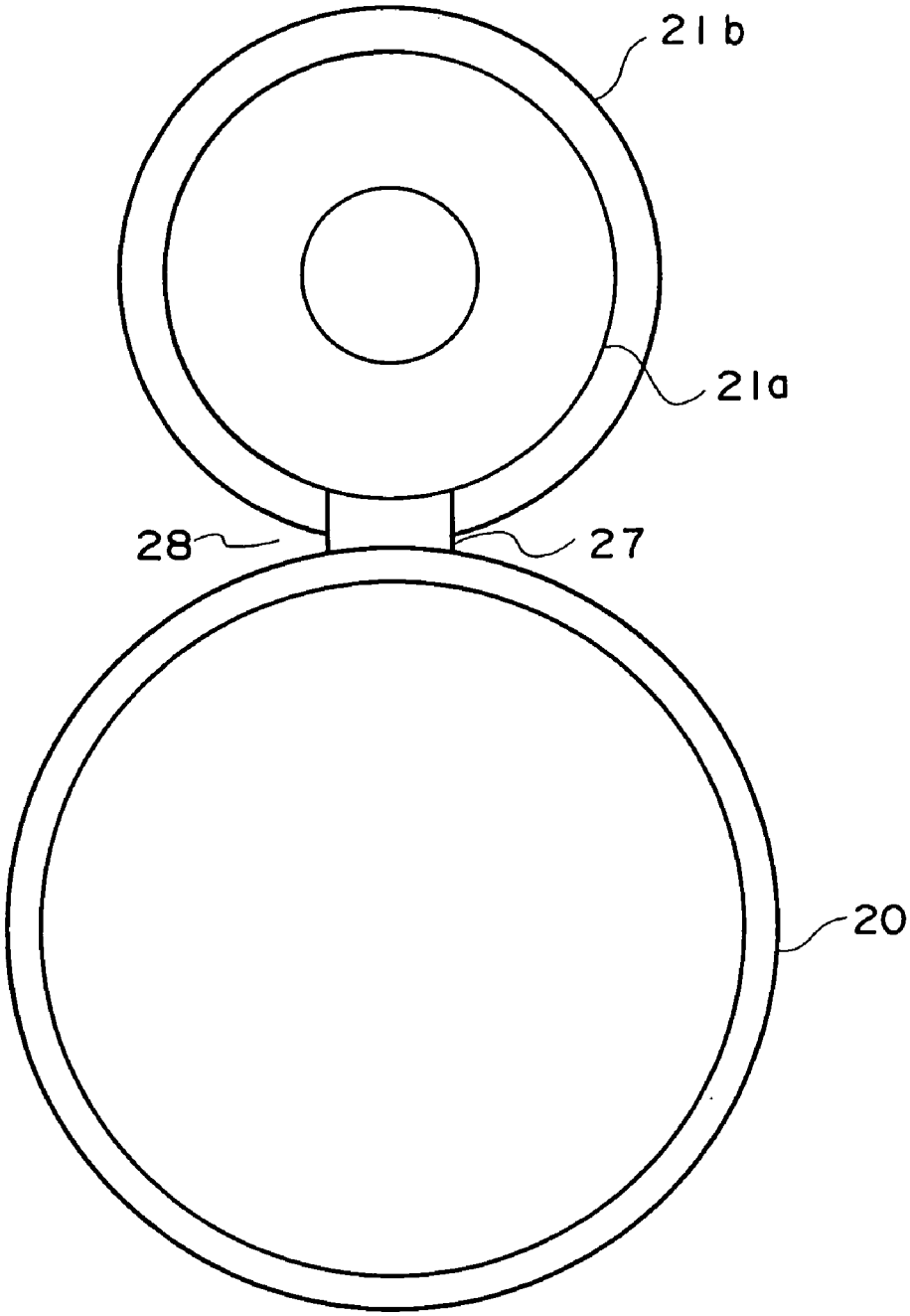
FIG. 4 is an enlarged view showing an arrangement of a charging roller in the embodiment of an image forming apparatus of the invention.

Next, the image forming apparatus of the embodiment will be explained with reference to FIG. 4. FIG. 4 is an enlarged view showing disposal of the charging roller in the image forming apparatus of the embodiment of the invention. The electrically conductive roller of the invention is strong and relatively hard. Therefore, when it is used a charging roller while being brought into contact with the photoreceptor 20, it damages the photoreceptor 20 for a short period of time. In order to avoid such a problem, the spacer member 21*b* is preferably provided at each end of the charging roller 21*a* to prevent the charging roller 21*a* from directly contacting the photoreceptor 20, and to charge the photoreceptor 20 in a discharging zone 27 with a constant gap 28 formed between the charging roller 21*a* and the photoreceptor 20.

The gap 28 is preferably 10 to 100 μm.

Figure 5:
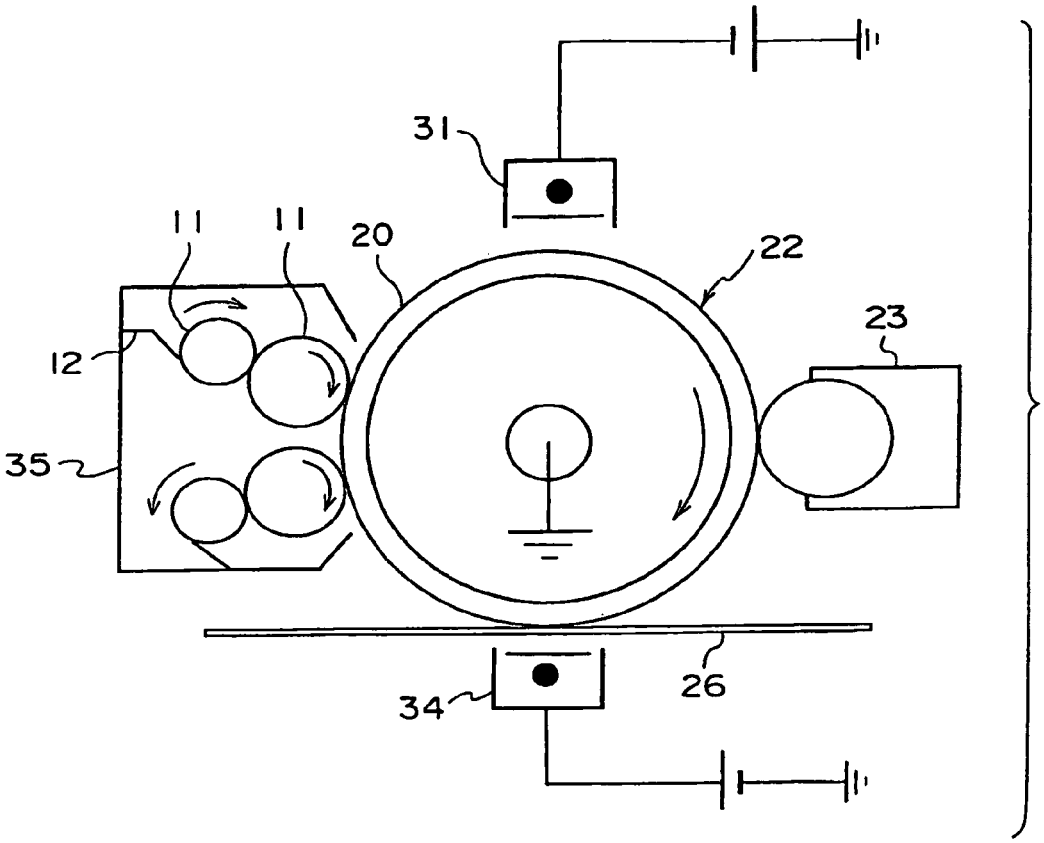
FIG. 5 shows the schematic structure of another embodiment of an image forming apparatus of the invention.

Another image forming apparatus of another embodiment of the invention having a cleaning unit of the invention will be explained with reference to FIG. 5. FIG. 5 is a schematic structural view explaining the image forming apparatus. In the image forming apparatus, images are formed in the same manner as in the image forming apparatus shown in FIG. 3 except that a charging electrode 31 and a transfer electrode 34 which are wire electrodes such as scorotron, or corotron are used, and that a cleaning unit 35 cleans the photoreceptor 20.

In FIG. 5, the same members as those used in the cleaning unit and the image forming apparatus of the invention shown in FIG. 3 have the same numerals and explanations therefor are omitted.

Since the image forming apparatus has the cleaning unit 35 of the invention, it can efficiently recover a toner remaining after transfer for a long period of time without using a blade. In addition, since an electrically conductive roller in the unit for cleaning an image holding member 35 has stable electrical resistivity and a stable shape, the unit for cleaning an image holding member 35 can be used repeatedly.

The image forming apparatus including the charging roller and the transfer roller shown in FIG. 3, and the image forming apparatus including the unit for cleaning an image holding member shown in FIG. 5 have been explained, but the charging roller, the transfer roller and the unit for cleaning an image holding member can be used together in the same image forming apparatus, or an image forming apparatus including either the charging roller or the transfer roller can be used.

A process cartridge can be formed by combining the components of the above-described image forming apparatuses, and can be replaced by attaching to and detaching from the main body of the image forming apparatus.

A process cartridge of a first embodiment of the invention has at least a hollow cylinder or belt-type image holding member, a charging member which is disposed near or brought into contact with the image holding member surface, and which is an electrically conductive member of the invention. Moreover, a process cartridge of a second embodiment of the invention has at least a hollow cylinder or belt-type image holding member and a unit for cleaning an image holding member of the invention.

Both of the above-described process cartridges can further include a developing unit. Each of the process cartridges can be detached from an image forming apparatus and replaced according to the life of the image holding member.

The process cartridge of the first embodiment may further include the unit for cleaning an image holding member of the invention, and the process cartridge of the second embodiment may further include the charging member which is an electrically conductive member of the invention.

Moreover, in the process cartridge of the second embodiment, the unit for cleaning an image holding member is preferably attached to and detached from the image holding member. This is because the unit for cleaning an image holding member has a longer life than the image holding member, and therefore it is preferable that only the image holding member is replaced to enable the process cartridge to be used repeatedly.

Usage of the charging member which is the electrically conductive member of the invention or the unit for cleaning an image holding member as the component of one process cartridge can avoid frequent maintenance, and replacing only such a process cartridge can enable high quality images to be repeatedly formed with ease.

Figure 6:
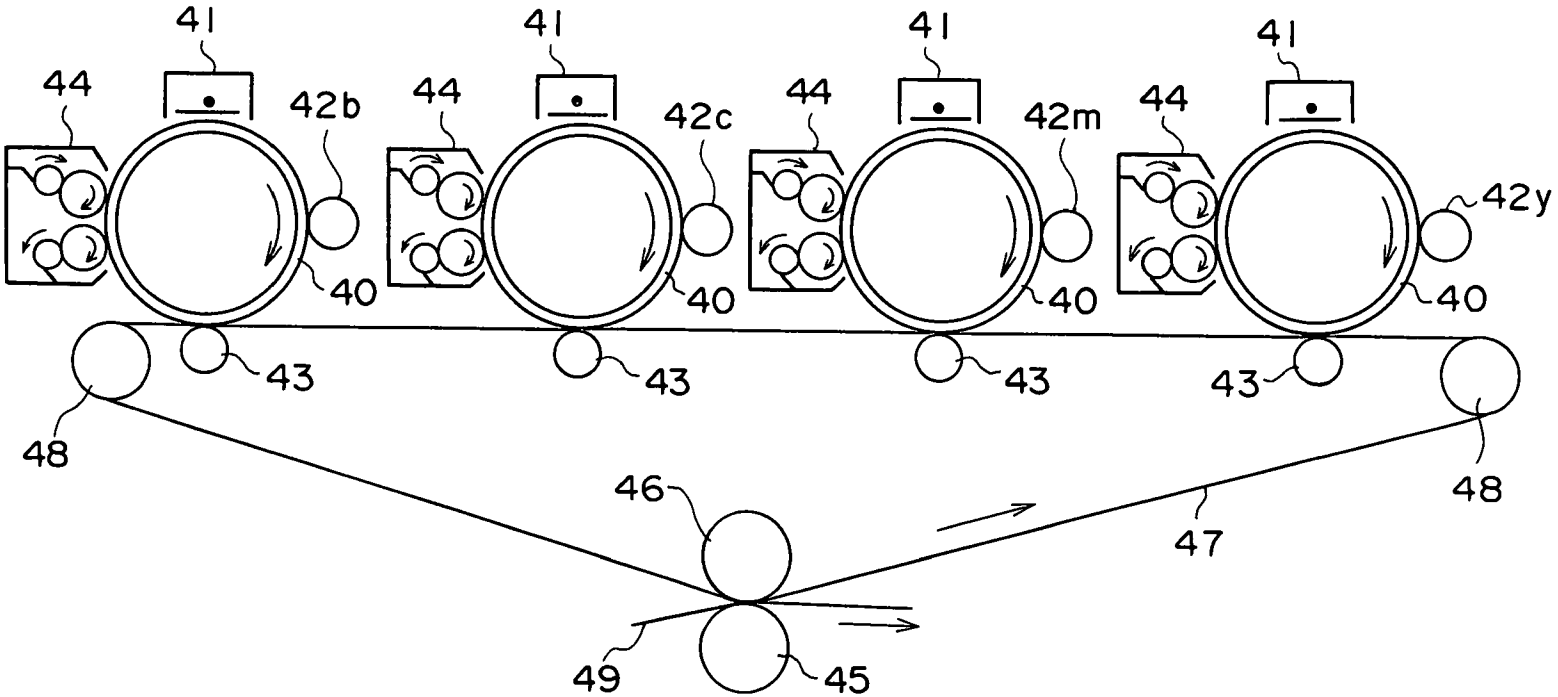
FIG. 6 shows the schematic structure of an embodiment of a tandem-type full-color image forming apparatus of the invention.

The electrically conductive member and unit for cleaning an image holding member of the invention can be used in a tandem-type color image forming apparatus shown in FIG. 6. FIG. 6 is a schematic structural view explaining a tandem-type color image forming apparatus of an embodiment of the invention using an electrically conductive member and a unit for cleaning an image holding member of the invention.

The tandem-type color image forming apparatus refers to an image forming apparatus having a plurality of photoreceptors.

In the tandem-type color image forming apparatus shown in FIG. 6, four image forming units 42*y*, 42*m*, 42*c* and 42*b* which form yellow, magenta, cyan and black toner images, are provided respectively in this order, and an intermediate transfer belt 47 passes through the transfer zone of each image forming unit (transfer zone of each photoreceptor drum). As in the image forming apparatus shown in FIG. 5, each image forming unit has a photoreceptor drum 40 (y, m, c, or k) which rotates in a direction shown by an arrow, and a charging electrode 41, a developing unit 42, a primary transfer roller (primary transfer member) 43, and a cleaning unit 44 which are provided around the photoreceptor drum 40 in this order. The intermediate transfer belt 47 is wound between a supporting roller 46 and winding rollers 48 so that the intermediate transfer belt rotates in a direction of an arrow while it is brought into contact with the transfer zone of each image forming unit. The position of each winding roller can be shifted, which is adaptable to change in the belt length.

In the image forming apparatus, a secondary transfer roller 45 transfers yellow, magenta, cyan and black toner images superimposed on the intermediate transfer belt 47 surface to a recording material 49 at the supporting roll 46 position. Thereafter, the recording material 49 is fed to a fixing unit not shown, whereby the toner images are fixed on the recording material 49 surface. Thus, a colored image is obtained. In the secondary transfer, a secondary transfer voltage is applied to the supporting roller 46.

In the image forming apparatus, the electrically conductive members of the invention are used as the primary transfer roller 43, supporting roller 46, and winding rollers 48, and the unit for cleaning an image holding member of the invention is used as the cleaning unit 44.

Although the intermediate transfer belt may be an electrically conductive resin belt, or an electrically conductive rubber belt, the intermediate belt which is made of a resin having a high elastic modulus and which hardly stretches is preferable from the viewpoint of color registration.

In a tandem-type image forming apparatus, although images can be formed at a high speed, an image holding member heavily wears off and therefore a cleaning method for the image holding member had been a major technical issue. The image forming apparatus of the invention, so-called "tandem-type," has a plurality of image holding members with units for cleaning an image holding member which clean the corresponding image holding member. Such a structure not only suppresses abrasion of the image holding member surface, but can also maintain cleaning properties even if images are formed at a high speed.

Moreover, since the image forming apparatus of the present embodiment includes the electrically conductive members of the invention as the primary transfer roller, the supporting roller and the winding rollers, high image quality can be maintained for a long period of time even if image formation is conducted at a high speed. In addition, since change in physical properties thereof and abrasion hardly occur, life of the device can lengthen, reducing running costs.

EXAMPLES

The invention will be described more specifically by way of examples but the invention is not limited to the examples.

Example 1

Preparation of Electrically Conductive Member (Charging Roller)

Eighteen parts by mass of acidic carbon black having a pH value of 4.5 (Printex 140T available from Degussa Huls Corp.) is added to 100 parts by mass of a polyether imide resin (Ultem 1010 manufactured by GE Plastics Japan Ltd.) serving as a polymer material. The resultant mixture is preliminarily kneaded by a banbury mixer and then kneaded by a biaxial extruder to form a pellet therefrom. The pellet is extrusion-molded into a resin tube having an outer diameter of 18 mm and a thickness of 4 mm by a monoaxial extruder. An electrically conductive adhesive is applied to the inner surface of the resin tube, and then a metal core (stainless shaft having an outer diameter of 10 mm) is inserted into the resin tube to obtain a desired charging roller.

The electrical resistivity of the obtained charging roller is $5\times10^6$ ohm, and unevenness of the resistivity in the peripheral direction of the roller is ±0.2 (log ohm).

The polyether imide resin composition has an abrasion amount of 10 mg, a Rockwell hardness of 109 and a bending elastic modulus of 3400 MPa.

The electrical resistivity of the charging roller is measured by placing the charging roller on a metal plate such as a copper plate, while a load of 500 grams is applied to each end of the roller, applying a voltage of 500 V to a circuit including the metal core of the charging roller and the metal plate, and measuring a current flow between the charging roller and the metal plate with a microcurrent measuring device (R8320 manufactured by Advantest Corp.). Electrical resistivities of rollers prepared in subsequent examples and comparative examples are measured by the above-described manner.

Moreover, the abrasion amount is measured by a method stipulated in JIS K6902, the Rockwell hardness (M scale) is measured by a method stipulated in JIS K7202, and the bending elastic modulus is measured by a method stipulated in JIS K7171. Abrasion amounts, Rockwell hardnesses and bending elastic moduli of the rollers prepared in subsequent examples and comparative examples are measured by the above methods.

Evaluation

A spacer made of POM with a thickness of 20 μm and a width of 2 mm is attached to each end of the molding portion of the charging roller. The charging roller is set in a monochrome image forming apparatus (the printing speed is 30 sheets/min. and A4 size sheets are fed so that the long edge thereof is parallel to a feeding path) so that a gap of 20 μm is formed between an organic photoreceptor and the charging roller.

A magnetic one-component toner obtained by mixing a styrene polymer with a magnetic powder is used as a developer of the image forming apparatus.

A DC constant voltage of −1400 V is applied to the shaft of the charging roller, and then a test for evaluating durability of the image forming apparatus during image formation is conducted on 50000 sheets under each of a standard environment (22° C. and 55% RH), an environment of a high temperature of 28° C. and a high humidity of 85% RH, and an environment of a low temperature of 10° C. and a low humidity of 15% RH. The initial charging amount of the photoreceptor under the standard environment is −720 V, and that under the environment of the high temperature and high humidity is −750 V, and that under the environment of the low temperature and low humidity is −700 V.

As a result, there is no quality difference between a first obtained image and an image obtained by the $50000^{th}$ printing in any environment, and all the obtained images have good quality. Moreover, there is little difference between the electrical resistivity of the charging roller before printing and that after 50000 images have been printed (electrical resistivity: $6\times10^5$ ohm, unevenness of resistivity in the peripheral direction: ±0.2 (log ohm)). Further, the scraped amount of the photoreceptor at each end thereof is 10 μm or less under any environment.

Example 2

Preparation of Electrically Conductive Member (Transfer Roller)

Fourteen parts by mass of acidic carbon black having a pH value of 4.5 (Printex 140T available from Degussa Huls Corp.) is added to 100 parts by mass of a polyether imide resin (Ultem 1010 manufactured by GE Plastics Japan Ltd.) serving as a polymer material. The resultant mixture is preliminarily kneaded by a banbury mixer and then kneaded by a biaxial extruder to form a pellet therefrom. The pellet is extrusion-molded into a resin tube having an outer diameter of 20 mm and a thickness of 4 mm by a monoaxial extruder. An electrically conductive adhesive is applied to the inner surface of the resin tube and then a metal core (stainless shaft having an outer diameter of 12 mm) is inserted into the resin tube to obtain a desired transfer roller.

The electrical resistivity of the obtained transfer roller is $2\times10^8$ ohm and unevenness of the resistivity in the peripheral direction of the roller is ±0.2 (log ohm) when a voltage of 500V is applied to the transfer roller.

The polyether imide resin composition has an abrasion amount of 10 mg, a Rockwell hardness of 109 and a bending elastic modulus of 3400 MPa.

Evaluation

The transfer roller is set in a monochrome image forming apparatus which is similar to that used in Example 1 (the printing speed is 30 sheets/min. and A4 size sheets are fed so that the long edge thereof is parallel to a feeding path) so that the transfer roller faces a photoreceptor. Springs are used to press a load of 100 grams against each end of the transfer roller.

A DC voltage is applied to the shaft of the transfer roller so that a constant current of 2 μA flows. Then, a test for evaluating durability of the image forming apparatus during image formation is conducted on 50000 sheets under each of a standard environment (22° C. and 55% RH), an environment of a high temperature of 28° C. and a high humidity of 85% RH, and an environment of a low temperature of 10° C. and a low humidity of 15% RH.

As a result, there is no quality difference between a first obtained image and an image obtained by the $50000^{th}$ printing in any environment, and all the obtained images have good quality. Moreover, there is little difference between the electrical resistivity of the transfer roller before printing and that after 50000 images have been printed (electrical resistivity: $3\times10^8$ ohm, unevenness of resistivity in the peripheral direction: ±0.2 (log ohm)). Further, little abrasion of the transfer roller is observed after the test is conducted.

Meanwhile, an unused transfer roller which is prepared in the above-described manner is set in the image forming apparatus shown in FIG. 3 in the same manner as above. A DC constant voltage of −1400 V is applied to the shaft of the transfer roller, and then a test for evaluating durability of the image forming apparatus during image formation is conducted on 50000 sheets under each of a standard environment (22° C. and 55% RH), an environment of a high temperature of 28° C. and a high humidity of 85% RH, and an environment of a low temperature of 10° C. and a low humidity of 15% RH.

As a result, as in the above case, there is no quality difference between a first obtained image and an image obtained by the $50000^{th}$ printing in any environment, and all the obtained images have good quality. Moreover, there is little difference between the electrical resistivity of the transfer roller before printing and that after 50000 images have been printed (electrical resistivity: $3\times10^8$ ohm, unevenness of resistivity in the peripheral direction: ±0.2 (log ohm)).

Example 3

Preparation of Electrically Conductive Member (Transfer Roller)

Fourteen parts by mass of acidic carbon black having a pH value of 4.5 (Printex 140T available from Degussa Huls Corp.) is added to 100 parts by mass of a polyether imide resin (Ultem 1010 manufactured by GE Plastics Japan Ltd.) serving as a polymer material. The resultant mixture is preliminarily kneaded by a banbury mixer and then kneaded by a biaxial extruder to form a pellet therefrom. The pellet is extrusion-molded into resin tubes having an outer diameter of 18 mm and a thickness of 4 mm by a monoaxial extruder. An electrically conductive adhesive is applied to the inner surface of each of the resin tubes and then a metal core (stainless shaft having an outer diameter of 10 mm) is inserted into each resin tube to obtain desired transfer rollers.

The electrical resistivity of each of the transfer rollers is $2\times10^8$ ohm and unevenness of the resistivity in the peripheral direction of each roller is ±0.2 (log ohm) when a voltage of 500V is applied to the transfer roller.

The polyether imide resin composition has an abrasion amount of 10 mg, a Rockwell hardness of 109 and a bending elastic modulus of 3400 MPa.

Evaluation

The transfer rollers are set as primary transfer rollers in a high-speed tandem-type full color image forming apparatus shown in FIG. 6 (the printing speed is 60 sheets/min. and A4 size sheets are fed so that the long edge thereof is parallel to a feeding path) so that each transfer roller faces an organic photoreceptor which can be negatively charged via an intermediate transfer belt. Springs are used to press a load of 300 grams to each end of each transfer roller.

Mixtures each including a polyester-containing toner (volume mean diameter: 6.5 μm, external additive: titanium oxide and silicone oil-containing silica) and a carrier are used as developers of the image forming apparatus and the toners are negatively charged.

A DC voltage is applied to the shaft of each of the primary transfer rollers so that a constant current of 10 μA flows. Then, a test for evaluating durability of the image forming apparatus during image formation is conducted on 50000 sheets under each of a standard environment (22° C. and 55% RH), an environment of a high temperature of 28° C. and a high humidity of 85% RH, and an environment of a low temperature of 10° C. and a low humidity of 15% RH.

As a result, there is no quality difference between a first obtained image and an image obtained by the $50000^{th}$ printing in any environment, and all the obtained images have good quality. Moreover, there is little difference between the electrical resistivity of the primary transfer roller before printing and that after 50000 images have been printed (electrical resistivity: $2\times10^8$ ohm, unevenness of resistivity in the peripheral direction: ±0.2 (log ohm)). Further, little abrasion of the internal surface of the intermediate transfer belt which is brought into contact with the primary transfer rollers is observed after the test is conducted.

Example 4

Preparation of Electrically Conductive Member (Supporting Roller)

Sixteen parts by mass of acidic carbon black having a pH value of 4.5 (Printex 140T available from Degussa Huls Corp.) is added, as an electrically conductive agent, to a phenol resin material (OR-85D manufactured by Saxin Corp.) including 100 parts by mass of a phenol resin and 100 parts by mass of a glass fiber to form a pellet. The pellet is extrusion-molded into a resin tube having an outer diameter of 18 mm and a thickness of 4 mm by a monoaxial extruder. An electrically conductive adhesive is applied to the inner surface of the resin tube and then a metal core (stainless shaft having an outer diameter of 10 mm) is inserted into the resin tube to obtain a desired supporting roller.

The electrical resistivity of the supporting roller is $5\times10^8$ ohm, and unevenness of the resistivity in the peripheral direction of the roller is ±0.1 (log ohm) when a voltage of 500V is applied to the supporting roller.

The resin composition has an abrasion amount of 13 mg, a Rockwell hardness of 120 and a bending elastic modulus of 12700 MPa.

Evaluation

The supporting roller is set in a high-speed tandem-type full color image forming apparatus similar to that used in Example 3 and shown in FIG. 6 (the printing speed is 60 sheets/min. and A4 size sheets are fed so that the long edge thereof is parallel to a feeding path) so that the supporting roller faces a secondary transfer roller via an intermediate transfer belt. A secondary voltage is applied to the supporting roller.

Then, a test for evaluating durability of the image forming apparatus during image formation is conducted on 50000 sheets under each of a standard environment (22° C. and 55% RH), an environment of a high temperature of 28° C. and a high humidity of 85% RH, and an environment of a low temperature of 10° C. and a low humidity of 15% RH.

As a result, there is no quality difference between a first obtained image and an image obtained by the $50000^{th}$ printing in any environment, and all the obtained images have good quality. Moreover, there is little difference between the electrical resistivity of the supporting roller before printing and that after 50000 images have been printed (electrical resistivity: $5\times10^8$ ohm, unevenness of resistivity in the peripheral direction: ±0.1 (log ohm)). Further, little abrasion of the internal surface of the intermediate transfer belt which is brought into contact with the supporting roller is observed after the test is conducted.

Example 5

Preparation of Electrically Conductive Roller

Sixteen parts by mass of acidic carbon black having a pH value of 4.5 (Printex 140T available from Degussa Huls Corp.) is added, as an electrically conductive agent, to a phenol resin material (OR-85D manufactured by Saxin Corp.) including 100 parts by mass of a phenol resin and 100 parts by mass of a glass fiber. The resultant is kneaded by a biaxial extruder to form a pellet. The phenol resin pellet is extrusion-molded into a resin tube having an outer diameter of 18 mm and a thickness of 4 mm by a monoaxial extruder. An electrically conductive adhesive is applied to the inner surface of the resin tube, and then a metal core is inserted into the resin tube to obtain a desired electrically conductive roller.

The electrical resistivity of the electrically conductive roller is $1\times10^8$ ohm and unevenness of the resistivity in the peripheral direction of the roller is ±0.1 (log ohm) when a voltage of 500V is applied to the roller.

Evaluation

A process cartridge including the electrically conductive roller, and an image holding member, a brush member, and a cleaning blade to be described below is set in a monochrome image forming apparatus shown in FIG. 5 (the printing speed is 50 sheets/min. and A4 size sheets are fed so that the long edge thereof is parallel to a feeding path). Then, a test for forming 200000 images is conducted.

A mixture of a styrene polymer-containing toner (volume mean diameter: 9.0 μm, external additive: silica and titania) and a Mn/Mg/Sr ferrite carrier is used as a developer of the image forming apparatus. The toner is negatively charged.

The structure of the process cartridge is as follows.

Image Holding Member

A negatively charged organic photoreceptor comprising a charge transport layer having a thickness of 30 μm and including polycarbonate First Cleaning Unit Brush Material: electrically conductive nylon (thickness: two denier (about 17 μm))

Electrical resistivity: $1\times10^5$ ohm

Fiber length: 4 mm

Density: $7.8\times10^3$ fibers/cm$^2$ (50000 fibers/inch$^2$)

Bite amount thereof with respect to photoreceptor: about 1.5 mm

Peripheral speed: 60 mm/sec.

Rotation direction: direction opposite to rotation direction of photoreceptor

Bias applied to brush: +200V

Electrically Conductive Roller

Material: phenol resin including glass fiber and carbon black

Electrical resistivity: $1\times10^8$ ohm

Bending elastic modulus: 12700 MPa

Abrasion amount: 13 mg

Rockwell hardness (M): 120

Bite amount thereof with respect to brush: 1.5 mm
Peripheral speed: 70 mm/sec.
Bias applied to roller: +600v Scraper
Material: SUS 304
Thickness: 80 μm
Bite amount thereof: 1.3 mm
Free length: 8.0 mm Second Cleaning Unit Brush
Material: electrically conductive nylon (thickness: two denier (about 17 μm))
Electrical resistivity: $1\times10^5$ ohm
Fiber length: 4 mm
Density: $7.8\times10^3$ fibers/cm$^2$ (50000 fibers/inch$^2$)
Bite amount thereof with respect to photoreceptor: about 1.5 mm
Peripheral speed: 60 mm/sec.
Rotation direction: direction opposite to rotation direction of photoreceptor
Bias applied to brush: −400V Electrically Conductive Roller
Material: phenol resin including glass fiber and carbon black
Electrical resistivity: $1\times10^8$ ohm
Bending elastic modulus: 12700 MPa
Abrasion amount: 13 mg
Rockwell hardness (M): 120
Bite amount thereof with respect to brush: 1.5 mm
Peripheral speed: 70 mm/sec.
Bias applied to roller: −800V Scraper
Material: SUS 304
Thickness: 80 μm
Bite amount thereof: 1.3 mm
Free length: 8.0 mm Evaluation After the image formation test, the 200000$^{th}$ image is checked, and no image defect arising from defective cleaning is observed. There are also no sharp scratches appearing on the resultant image of the photoreceptor surface, and toner filming does not occur. Moreover, there are no observations of toner accumulating on any brush member, bending of a tip of any brush member, nor any major changes in any of the electrically conductive rollers. Electrical resistivity of the roller is $1\times10^8$ ohm, unevenness of the resistivity in the peripheral direction is +0.1 (log ohm), and the scraped amount is such that the diameter of the roller after image formation is smaller than the initial diameter by only 0.5 μm. Further, no major changes and hardly any scraping are observed with respect to any of the scrapers.

Example 6

Acidic carbon black having a pH value of 4.5 (Printex 140T available from Degussa Huls Corp.) is added, as an electrically conductive agent, to a polyether imide resin serving as a resin material of an electrically conductive roller, and an electrically conductive roller is made of the resultant.

For evaluation, a test for forming 600000 images is conducted in the same manner as in Example 5, except that a tandem-type full color image forming apparatus shown in FIG. 6 (the printing speed is 60 sheets/min. and A4 size sheets are fed so that the long edge thereof is parallel to a feeding path) is used instead of the image forming apparatus shown in FIG. 5, and that a process cartridge including the electrically conductive roller, and an image holding member, a brush member, and a cleaning blade (scraper) to be described below is used. The structure of the process cartridge is as follows.

Image Holding Member
An organic photoreceptor comprising a charge transport layer having a thickness of 30 μm and including polycarbonate First Cleaning Unit Brush
Material: electrically conductive nylon (thickness: two denier (about 17 μm))
Electrical resistivity: $1\times10^5$ ohm
Fiber length: 4 mm
Density: $7.8\times10^3$ fibers/cm$^2$ (50000 fibers/inch$^2$)
Bite amount thereof with respect to photoreceptor: about 1.5 mm
Peripheral speed: 60 mm/sec.
Rotation direction: direction opposite to rotation direction of photoreceptor
Bias applied to brush: +200V Electrically Conductive Roller
Material: polyether imide resin in which carbon black is dispersed
Electrical resistivity: $1\times10^8$ ohm
Bending elastic modulus: 3400 MPa
Abrasion amount: 10 mg
Rockwell hardness (M): $10^9$
Bite amount thereof with respect to brush: 1.5 mm
Peripheral speed: 70 mm/sec.
Bias applied to roller: +600V Scraper
Material: SUS 304
Thickness: 80 μm
Bite amount thereof: 1.3 mm
Free length: 8.0 mm Second Cleaning Unit Brush
Material: electrically conductive nylon (thickness: two denier (about 17 μm))
Electrical resistivity: $1\times10^5$ ohm
Fiber length: 4 mm
Density: $7.8\times10^3$ fibers/cm$^2$ (50000 fibers/inch$^2$)
Bite amount thereof with respect to photoreceptor: about 1.5 mm
Peripheral speed: 60 mm/sec.
Rotation direction: direction opposite to rotation direction of photoreceptor
Bias applied to brush: −400V Electrically Conductive Roller
Material: polyether imide resin in which carbon black is dispersed
Electrical resistivity: $1\times10^8$ ohm
Bending elastic modulus: 3400 MPa
Abrasion amount: 10 mg
Rockwell hardness (M): 109
Bite amount thereof with respect to brush: 1.5 mm Peripheral speed: 70 mm/sec.
Bias applied to roller: −800V Scraper Material: SUS 304 Thickness: 80 pm Bite amount thereof: 1.3 mm Free length: 8.0 mm After the image formation test, the 600000$^{th}$ image is checked, and no image defect arising from defective cleaning is observed. There are also no sharp scratches appearing on the resultant image of the photoreceptor surface, and toner filming does not occur. Moreover, there are no observations of toner accumulating on any brush member, bending of a tip of any brush member, nor any major changes in any of the electrically conductive rollers. Electrical resistivity of the roller is $1\times10^8$ ohm, unevenness of the resistivity in the peripheral direction is ±0.1 (log ohm), and the scraped amount is such that the diameter of the roller after image formation is smaller than the initial diameter by only 1.0 μm. Further, no major changes and hardly any scraping are observed with respect to any of the scrapers.

Comparative Example 1

Acidic carbon black having a pH value of 4.5 (Printex 140T available fromDegussa Huls Corp.) is added, as an electrically conductive agent, to a polybuthylene terephthalate resin (Novadur 5010R7 commercially available from Mitsubishi Engineering-Plastics Corporation) serving as a resin material of an electrically conductive roller, and an electrically conductive roller is made of the resultant.

For evaluation, a test for forming 600000 images is conducted in the same manner as in Example 5, except that a tandem-type full color image forming apparatus shown in FIG. 6 (the printing speed is 60 sheets/min. and A4 size sheets are fed so that the long edge thereof is parallel to a feeding path) is used instead of the image forming apparatus shown in FIG. 5 and that a process cartridge including the electrically conductive roller, and an image holding member, a brush member, and a cleaning blade (scraper) to be described below is used. The structure of the process cartridge is as follows.

Image Holding Member

An organic photoreceptor comprising a charge transport layer having a thickness of 30 μm and including polycarbonate First Cleaning Unit Brush Material: electrically conductive nylon (thickness: two denier (about 17 pm))

Electrical resistivity: $1\times10^5$ ohm

Fiber length: 4 mm

Density: $7.8\times10^3$ fibers/cm$^2$ (50000 fibers/inch$^2$)

Bite amount thereof with respect to photoreceptor: about 1.5 mm

Peripheral speed: 60 mm/sec.

Rotation direction: direction opposite to rotation direction of photoreceptor

Bias applied to brush: +200V

Electrically Conductive Roller

Material: Polybuthylene terephthalate resin in which carbon black is dispersed

Electrical resistivity: $3\times10^8$ ohm

Bending elastic modulus: 2380 MPa

Abrasion amount: 30 mg

Rockwell hardness (M): 95

Bite amount thereof with respect to brush: 1.5 mm

Peripheral speed: 70 mm/sec.

Bias applied to roller: +600V

Scraper

Material: SUS 304

Thickness: 80 μm

Bite amount thereof: 1.3 mm

Free length: 8.0 mm

Second Cleaning Unit

Brush

Material: electrically conductive nylon (thickness: two denier (about 17 μm))

Electrical resistivity: $1\times10^5$ ohm

Fiber length: 4 mm

Density: $7.8\times10^3$ fibers/cm$^2$ (50000 fibers/inch$^2$)

Bite amount thereof with respect to photoreceptor: about 1.5 mm

Peripheral speed: 60 mm/sec.

Rotation direction: direction opposite to rotation direction of photoreceptor

Bias applied to brush: −400V

Electrically conductive roller

Material: Polybuthylene terephthalate resin in which carbon black is dispersed

Electrical resistivity: $3\times10^8$ ohm

Bending elastic modulus: 2380 MPa

Abrasion amount: 30 mg

Rockwell hardness (M): 95

Bite amount thereof with respect to brush: 1.5 mm

Peripheral speed: 70 mm/sec.

Bias applied to roller: −800V

Scraper

Material: SUS 304

Thickness: 80 μm

Bite amount thereof: 1.3 mm

Free length: 8.0 mm

After the image formation test, the 50000$^{th}$ image is checked, and an image defect caused by defective cleaning is observed.

Comparative Example 2

Acidic carbon black having a pH value of 4.5 (Printex 140T available from Degussa Huls Corp.) isadded, as an electrically conductive agent, to a polyethylene terephthalate resin including 15 wt % of a glass fiber (Lemapet 215 commercially available from Mitsubishi Engineering-Plastics Corporation) serving as a resin material of an electrically conductive roller, and an electrically conductive roller is made of the resultant.

For evaluation, a test for forming 600000 images is conducted in the same manner as in Example 5, except that a tandem-type full color image forming apparatus shown in FIG. 6 (the printing speed is 60 sheets/min. and A4 size sheets are fed so that the long edge thereof is parallel to a feeding path) is used instead of the image forming apparatus shown in FIG. 5, and that a process cartridge including the electrically conductive roller, and an image holding member, a brush member, and a cleaning blade (scraper) to be described below is used. The structure of the process cartridge is as follows.

Image Holding Member

An organic photoreceptor comprising a charge transport layer having a thickness of 30 μm and including polycarbonate First Cleaning Unit Brush Material: electrically conductive nylon (thickness: two denier (about 17 μm))

Electrical resistivity: $1\times10^5$ ohm

Fiber length: 4 mm

Density: $7.8\times10^3$ fibers/cm$^2$ (50000 fibers/inch$^2$)

Bite amount thereof with respect to photoreceptor: about 1.5 mm

Peripheral speed: 60 mm/sec.

Rotation direction: direction opposite to rotation direction of photoreceptor

Bias applied to brush: +200V

Electrically Conductive Roller

Material: Polyethylene terephthalate resin reinforced with glass fiber and including carbon black dispersed therein Electrical resistivity: $2\times10^8$ ohm Bending elastic modulus: 5680 MPa Abrasion amount: 22 mg Rockwell hardness (M): 96

Bite amount thereof with respect to brush: 1.5 mm

Peripheral speed: 70 mm/sec.

Bias applied to roller: +600V

Scraper

Material: SUS 304

Thickness: 80 μm

Bite amount thereof: 1.3 mm

Free length: 8.0 mm

Second Cleaning Unit

Brush

Material: electrically conductive nylon (thickness: two denier (about 17 μm))

Electrical resistivity: $1\times10^5$ ohm

Fiber length: 4 mm

Density: $7.8\times10^3$ fibers/cm$^2$ (50000 fibers/inch$^2$)

Bite amount thereof with respect to photoreceptor: about 1.5 mm

Peripheral speed: 60 mm/sec.

Rotation direction: direction opposite to rotation direction of photoreceptor

Bias applied to brush: −400V

Electrically Conductive Roller

Material: Polyethylene terephthalate resin reinforced with glass fiber and including carbon black dispersed therein Electrical resistivity: $2\times10^5$ ohm Bending elastic modulus: 5680 MPa Abrasion amount: 22 mg Rockwell hardness (M): 96

Bite amount thereof with respect to brush: 1.5 mm

Peripheral speed: 70 mm/sec.

Bias applied to roller: −800V

Scraper

Material: SUS 304

Thickness: 80 μm

Bite amount thereof: 1.3 mm

Free length: 8.0 mm

After the image formation test, the 350000$^{th}$ image is checked, and an image defect caused by defective cleaning is observed.

What is claimed is:

1. An electrically conductive member comprising a core and a resin layer provided on an outer peripheral surface of the core, wherein the resin layer is made of a resin composition in which an electrically conductive agent is dispersed, and the abrasion amount of the resin composition, measured by Japanese Industrial Standard K6902, is 20 mg or less; and wherein a bending elastic modulus of the resin composition, measured by Japanese Industrial Standard K7171, is at least 2000 MPa.

2. An electrically conductive member according to claim 1, wherein the resin composition has an M scale Rockwell hardness, measured by Japanese Industrial Standard K7202, of at least 100.

3. An electrically conductive member according to claim 1, wherein the electrically conductive member is an electrically conductive roller having an electrical resistivity of $1\times10^5$ to $1\times10^{10}$ ohm when an voltage of 500 V is applied to the electrically conductive roller.

4. An electrically conductive member according to claim 1, wherein the electrically conductive member is a charging member disposed near or brought into contact with a surface of an image holding member.

5. A process cartridge including an image holding member, and a charging member disposed near or brought into contact with an image holding member surface, wherein the charging member is an electrically conductive member according to claim 4.

6. An electrically conductive member according to claim 1, wherein the electrically conductive member is a transfer member disposed near or brought into contact with a surface of an image holding member.

7. An electrically conductive member according to claim 1, wherein the electrically conductive member is a primary transfer member facing an image holding member via an intermediate transfer member, and the intermediate transfer member is disposed near or brought into contact with a surface of the image holding member, and the primary transfer member is pressed against the intermediate transfer member.

8. An electrically conductive member according to claim 1, wherein the electrically conductive member is a supporting roller facing a secondary transfer member via an intermediate transfer member, and a secondary transfer voltage is applied to the supporting roller.

9. An electrically conductive member according to claim 1, wherein the electrically conductive member is a winding roller around which an intermediate transfer belt is wound in a tension state.

10. A unit for cleaning an image holding member, comprising a brush member brought into contact with an image holding member surface, an electrically conductive roller brought into contact with the brush member, and a blade brought into contact with the electrically conductive roller, wherein the electrically conductive member is an electrically conductive roller according to claim 1.

11. A process cartridge including an image holding member, and a unit for cleaning an image holding member, wherein the unit for cleaning an image holding member is a unit for cleaning an image holding member according to claim 10.

12. A process cartridge according to claim 11, wherein the unit for cleaning an image holding member can be attached to and detached from the image holding member.

13. An image forming apparatus comprising a unit for cleaning an image holding member according to claim 10.

14. An image forming apparatus according to claim 13, wherein cleaning biases are applied to the brush member and the electrically conductive roller so that a potential difference is generated between a cleaning bias applied to the brush member and a cleaning bias applied to the electrically conductive roller.

15. An image forming apparatus according to claim 13, comprising a plurality of units for cleaning an image holding member disposed along a moving direction of an image holding member, wherein a voltage is applied to each of the units for cleaning an image holding member so that polarities of voltages applied to the respective units for cleaning an image holding member alternate between positive and negative along the moving direction of the image holding member.

16. An image forming apparatus according to claims 15, wherein the polarity of a voltage applied to a unit for cleaning an image holding member disposed farthest upstream in a moving direction of the image holding member is different from the polarity of a toner on a surface of a developer holding member.

17. An image forming apparatus comprising an electrically conductive member according to claim 1.

* * * * *